US005805081A

United States Patent [19]

Fikacek

[11] Patent Number: 5,805,081

[45] Date of Patent: Sep. 8, 1998

[54] PORTABLE TRAFFIC SIGNALS

[76] Inventor: Karel John Fikacek, 22924 Detour, St. Clair Shores, Mich. 48082

[21] Appl. No.: 771,900

[22] Filed: Dec. 23, 1996

[51] Int. Cl.[6] ..... G08G 1/095

[52] U.S. Cl. ..... 340/908; 340/907; 340/906; 340/916

[58] Field of Search ..... 340/907, 908, 340/916, 902, 906; 364/436

[56] References Cited

U.S. PATENT DOCUMENTS

| | | | |
|---|---|---|---|
| 2,401,940 | 6/1946 | Lange | 340/908 |
| 2,865,017 | 12/1958 | Heikes | 340/907 |
| 4,032,883 | 6/1977 | Gibson | 340/908 |
| 4,401,969 | 8/1983 | Green et al. | 340/41 R |
| 4,543,905 | 10/1985 | McKenney | 340/908 |
| 4,616,225 | 10/1986 | Woudenberg | 340/908 |
| 5,252,969 | 10/1993 | Kishi | 340/908 |
| 5,294,138 | 3/1994 | Yang | 340/908 |
| 5,633,629 | 5/1997 | Hochstein | 340/907 |

*Primary Examiner*—Jeffery A. Hofsass
*Assistant Examiner*—Anh La
*Attorney, Agent, or Firm*—Alex Rhodes

[57] ABSTRACT

A portable signal for traffic control at intersections, school crossings, traffic accidents, road repairs, and road construction. In the first aspect of the invention, the signal is suspended from an overhead cable which supports an existing traffic signal. The signal is formed by attaching one or more detachable light panels to the sides of a control module. Each light panel is comprised of a rectangular housing and a vertical array of red, amber and green lights mounted in the housing. The control module is a generally rectangular unit comprised of a housing and controls, timing circuits and a power supply mounted in the housing. The timing circuits are conventional and control the "on" and "off" periods of the red, amber and green lights. A remotely controlled power hoist is attached to the top of the control module for raising and lowering the traffic signal. In a second aspect of the invention, the traffic signal is supported on a vertical post which rests on a road surface. In a third aspect of the invention the traffic signal is supported on an open bed of a pick-up truck.

12 Claims, 6 Drawing Sheets

PORTABLE TRAFFIC SIGNALS

FIELD OF THE INVENTION

This invention relates to traffic signals and more particularly to a temporary signal for traffic control at school crossings and during events, such as, power failures, traffic accidents, road repairs, and road construction.

BACKGROUND OF THE INVENTION

The current practice is to use police and signalmen for controlling traffic at intersections during power failures, school crossings, traffic accidents, road repairs, and road construction. This practice has several disadvantages. One disadvantage of this practice is that police officers are diverted from important regular assignments. Another disadvantage is that the use of signalmen increases the costs of road repairs and road construction. Another disadvantage is that police and signalmen are sometime unavailable for directing traffic.

SUMMARY OF THE INVENTION

The present invention overcomes the above disadvantages by providing an effective portable signal which can be quickly installed for reducing traffic congestion. One advantage of the invention is that it eliminates police and signalmen for controlling traffic. Another advantage is that it can be made readily available for controlling traffic. Another advantage is that it can be easily assembled, disassembled and transported in vehicle luggage compartments and trucks. Another advantage is that it is effective for reducing traffic congestion. Another advantage is that it is adaptable for a variety of traffic patterns. Another advantage is that it can be operated from a road surface, a truck bed or an overhead cable.

In the first aspect of the invention, one or more light panels are attached to the sides of a control module to form a traffic signal. The number of panels varies according to traffic conditions. Each light panel is comprised of a rectangular housing and a vertical array of red, amber and green lights mounted in the housing. After the light panels are attached to the control module, the duty cycles of the colored lights are adjusted and synchronized with other traffic signals to optimize the flow of traffic. The traffic signal is then raised with a remote controlled power hoist and suspended from an overhead cable. The overhead cable is preferably a cable which carries an existing and inoperative conventional traffic signal.

The control module is a generally rectangular module comprised of controls, timing circuits and a power supply mounted in a rectangular housing. The timing circuits are conventional and control the sequencing of the "on" and "off" cycles of the red, amber and green lights of each of the panels. The controls are also conventional and control the lengths of the duty cycles of the lights.

In a second aspect of the invention, the traffic signal is mounted on a vertical post. The vertical post extends downwardly from the signal to a base which rests on a road surface. In a third aspect of the invention the traffic signal is mounted on an end portion of a horizontal arm. The horizontal arm extends to a vertical post which is supported on a circular base. The circular base rests on a road surface or open bed of a truck.

Further objects, benefits and features of the invention will become apparent from the detailed description that follows and drawings that disclose the invention. The property in which exclusive rights are claimed is set forth in each of the numbered claims at the conclusion of the detailed description.

DETAILED DESCRIPTION OF THE PREFERRED EMBODIMENT

Figure 1:
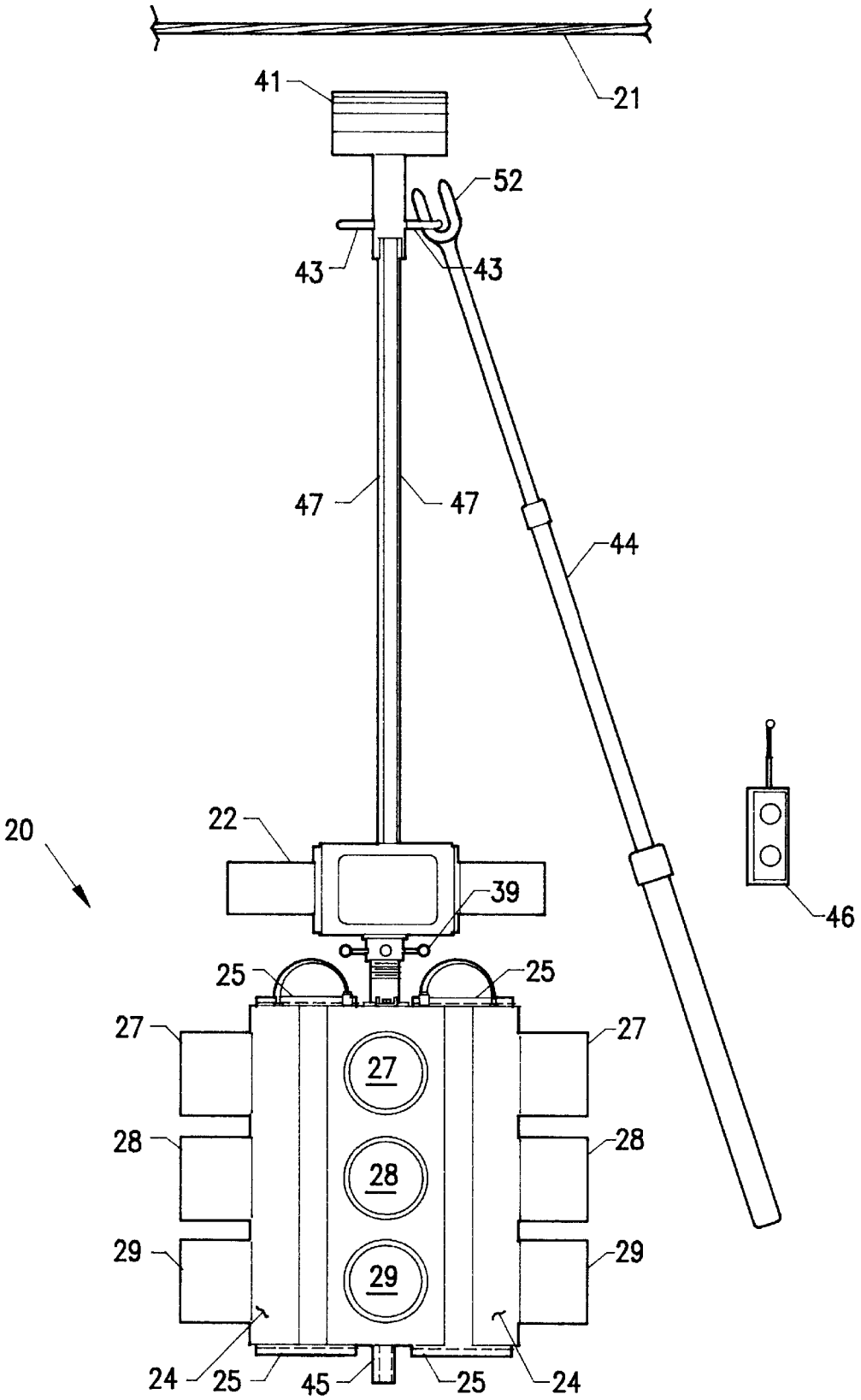
FIG. 1 is a front elevational view of a single portable traffic signal spaced below a horizontal support cable according to the invention.

Referring now to the drawings wherein like numerals designate like and corresponding parts throughout the several views, a first aspect of a portable traffic signal according to the invention is illustrated in FIGS. 1 through 5, inclusive. It is anticipated that the traffic signal 20 will be stored in a vehicle luggage compartment or a truck, however, it can be also stored in school and other buildings for use when a need arises.

One feature of the invention is that its operation can be synchronized with other traffic signals. Another feature is that an overhead cable 21 which is used for suspending an existing traffic signal is used for suspending the traffic signal 20. Another feature is that the traffic signal 20 is raised and lowered with a power hoist 22. Another feature is that the traffic signal 20 can be easily assembled and compactly stored in disassembled form in a vehicles luggage compartment or open bed of a truck.

With reference to FIGS. 2 through 5, the traffic signal 20 is comprised of a rectangular control module 23 and a group of detachable light panels 24 attached to the sides of the control module 23. The light panels 24 are attached to the control module 23 with brackets which extend outwardly from a top portion of the module 23.

Each light panel 24 is comprised of a rectangular housing 26, preferably made of a light material such as plastic or aluminum, and a vertical array of lights mounted in the housing 26. The lights are conventional and consist of an upper red light 27, a center amber light 28 and a lower green light 29. The lights are operatively connected to the control module 23 with plugs 30 at end portions of cables 31 which engage sockets 32 of the module 23. The cables 31 supply power and signals for timing the operation of the lights 27, 28 and 29.

The control module 23 is comprised of a conventional power supply 33, controls 34 and timing circuits 35 mounted in a generally rectangular housing 36. The power supply 33 provides power to the timing circuits 35, lights 27, 28 and 29 and hoist 22. The controls 34 are used for manually synchronizing the traffic signal 20 with other traffic signals and adjusting the duty cycles of the lights 27, 28 and 29. The number of light panels 24 on the module 23 will vary with traffic conditions. By way of example, for controlling traffic on a one way street only a single light panel 24 will be necessary whereas four light panels 24 will be used at an intersection. However, for all cases, four light panels 24 can mounted on the module 23 and selectively made operational with a control 34 or by disconnecting the cables 31 as needed.

In place of the manual controls 34, a transmitter (not shown) mounted in the module 23 can be used with receivers (not shown) mounted in other traffic signals for synchronizing the traffic signal 20 with the other traffic signals. In such case, the traffic signal 20 serves as a master and the other traffic signals as slaves. A traffic control system in which slave traffic signals are controlled by a master control signal is disclosed in U.S. Pat. No. 4,401,969 which is incorporated herein by reference. Modulated carrier signals are transmitted via an antenna 37 to the slaves where they are processed to activate and de-activate the lights of the slaves.

Figure 2:
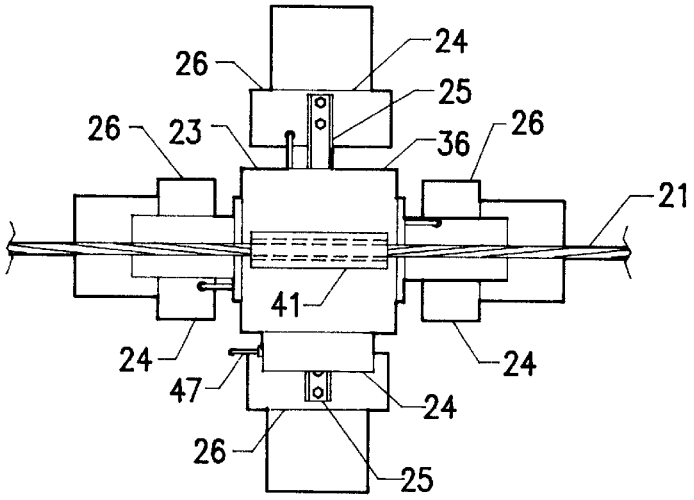
FIG. 2 is a plan view of the portable traffic signal and support cable.
Figure 3:
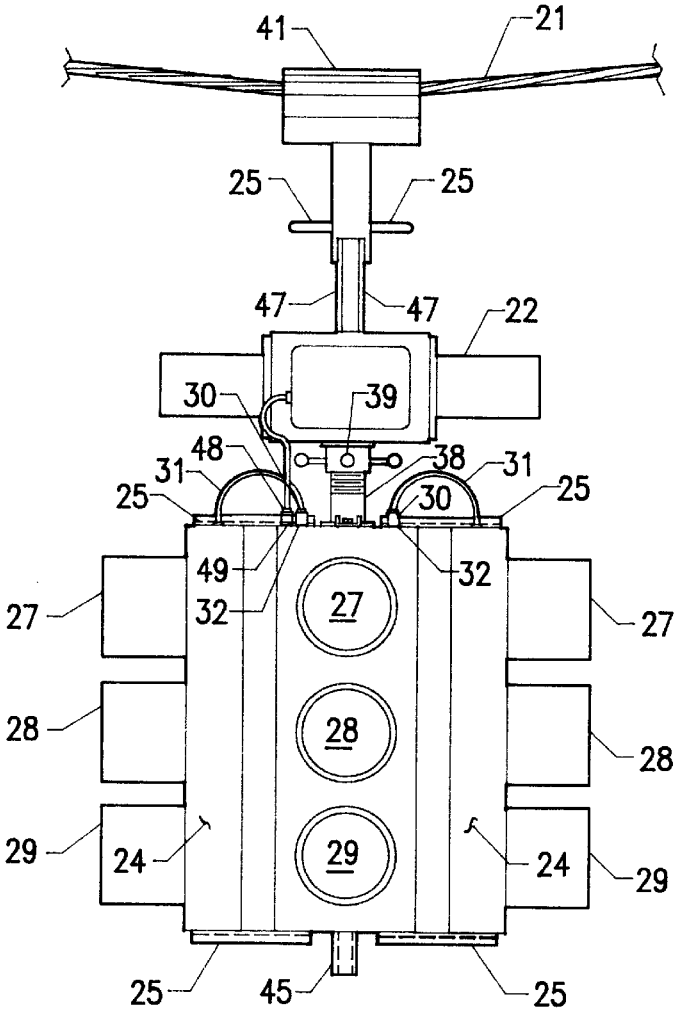
FIG. 3 is a front elevational view of the portable traffic signal in an elevated position adjacent to the support cable.
Figure 5:
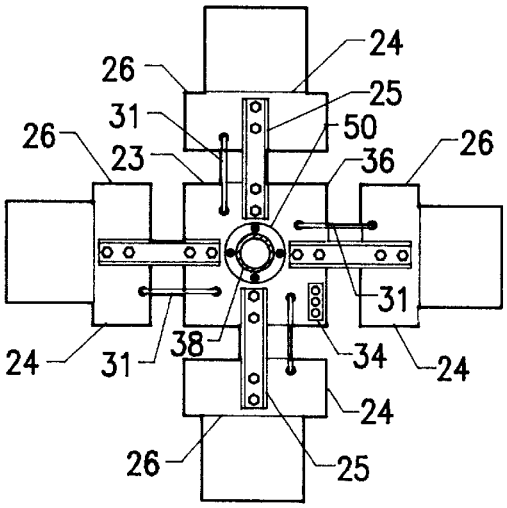
FIG. 5 is a cross-sectional view taken on the line 5—5 in FIG. 4.
Figure 4:
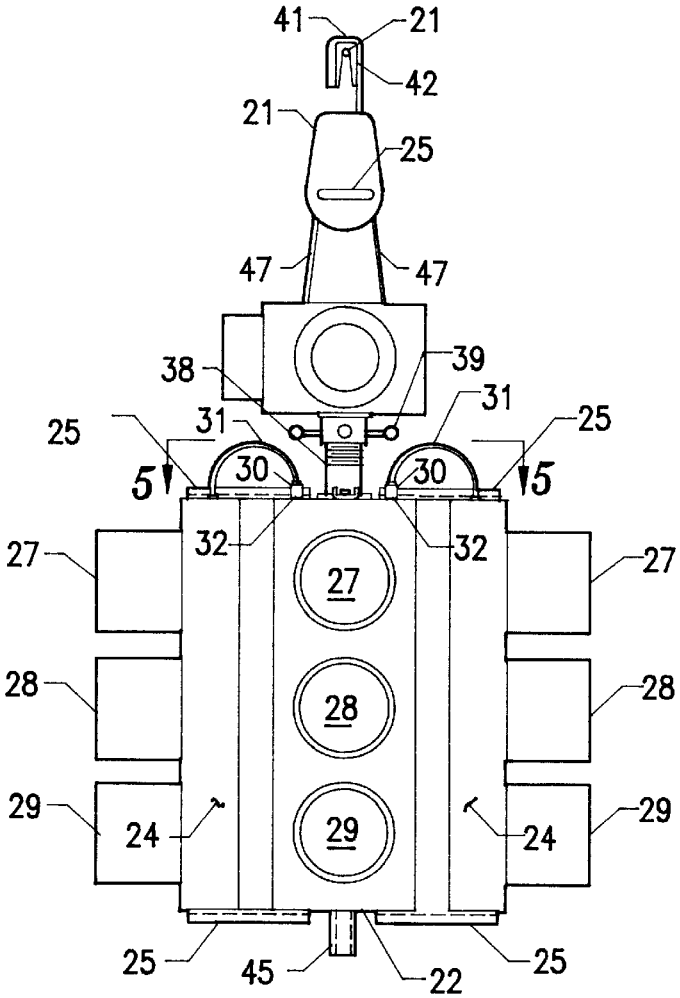
FIG. 4 is a side elevational view of the portable traffic signal in the elevated position.

Referring now to FIGS. 1, 2 and 3, the power hoist 22 is detachably mounted on the upper portion of the control module 23 for raising and lowering the traffic signal 20. The hoist 22 is attached to the control module 23 with a sleeve 38 having an upper end portion which is rotatably mounted to the hoist 22 and a lower portion which is detachably mounted to the control module 23. A hand wheel 39 threadably engages the sleeve 38 and is used for locking the upper portion of the sleeve 38 to the hoist 22. The hand wheel 39 is loosened for aligning the traffic signal 20 with vehicle traffic before the traffic signal 20 is suspended from the overhead cable 21. Attached to an upper end portion of the hoists cables 47 is a hook 41 for attaching the cables 47 to the overhead cable 21. The inner portions of the hook 41 are covered with a rubber liner 42 to frictionally retard the hook 41 from moving on the overhead cable 21. On opposite sides of the hook 41 are a pair of brackets 43 for raising the hook 41 with a rod 44. The rod 44 is preferably telescopic for storage. At the bottom of the control module 23 is a tubular member 45 for alternate mountings which will be later described. A battery powered remote hoist control 46 is provided for raising and lowering the traffic signal 20 with the hoist 22. Power is supplied to the hoist 22 by a cable 47 having a plug end portion 48 which engages a socket 49 of the module 23.

The method of using the traffic signal 20 is essentially a three step process, namely, (1) assembly, (2) synchronization, and (3) mounting. The assembly step consists of attaching an appropriate number of light panels 24 to the brackets 25 extending outwardly from the control module 23, engaging the plugs 30 at the ends of the respective cables 31 with the control module sockets 32, mounting the hoist 22 by attaching the flange 50 at the lower end portion of the sleeve 38 to the control module 23, connecting the plug 48 at the end of the hoist cable 47 with the control module socket 49, orienting the hoist 22 on the control module 23 by loosening the hand wheel 39, rotating the hoist 22 and tightening the hand wheel 39. Synchronization consists of setting the controls 34 on the top portion of the control module 23 with other traffic signals. Mounting consists of reeling out a length of cables 47 from the hoist 22 with the remote control 46, engaging the "U" shaped end portion 52 of the rod 44 with one of the brackets 43 on the sides of the hook 41, manually elevating the hook 41 with the rod 44, engaging the hook 41 with the overhead cable 21, disengaging the rod 44 with the hook 41, and raising the traffic signal 20 with the control 34.

Figure 6:
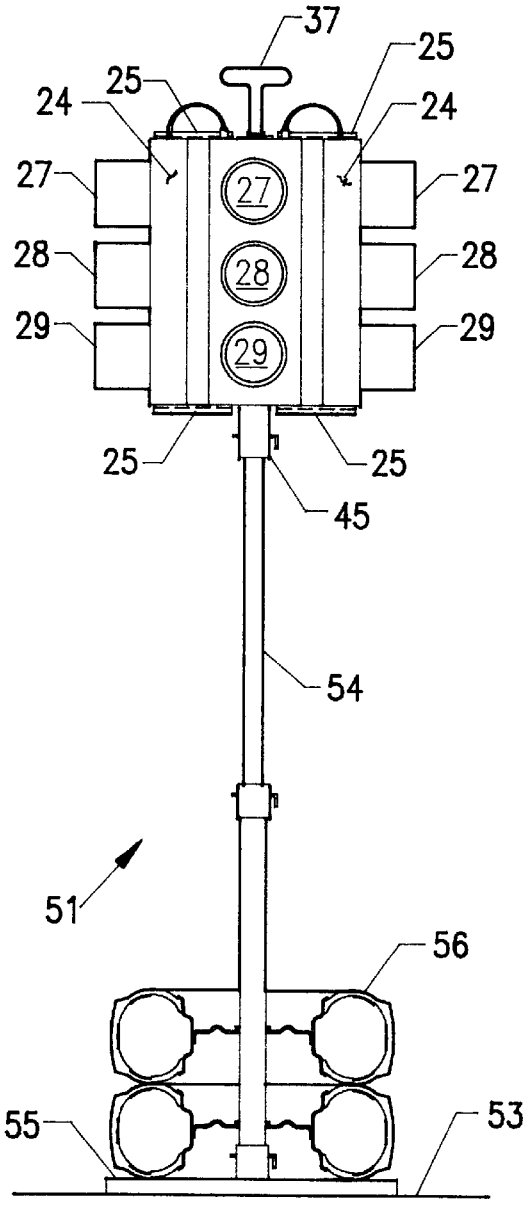
FIG. 6 is a front elevational view of an alternate embodiment.
Figure 7:
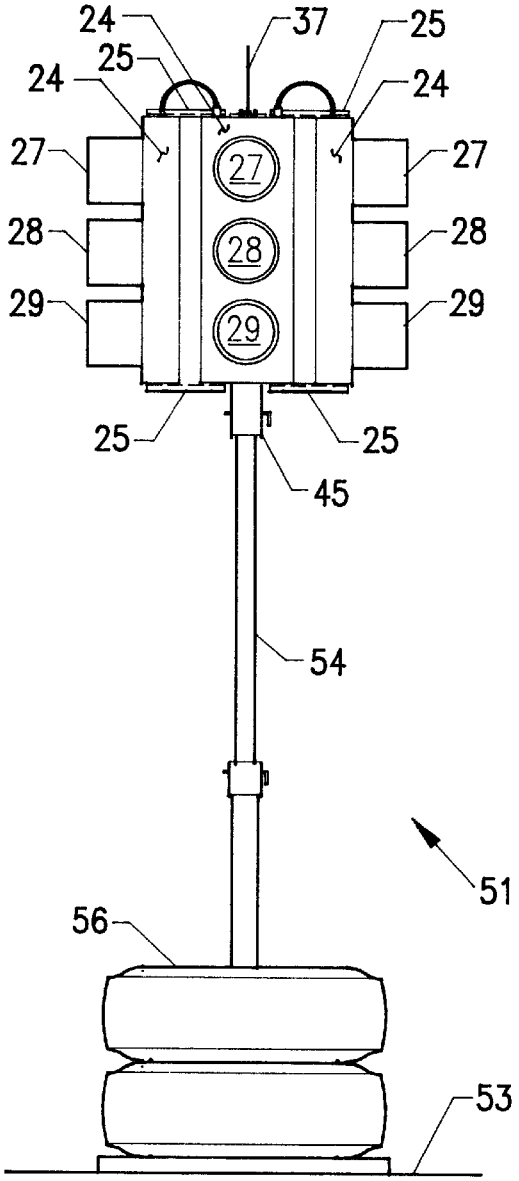
FIG. 7 is a side elevational view of the alternate embodiment in partial section.

Referring now to FIGS. 6 and 7, an embodiment is shown wherein the traffic signal 20 is supported on a road 53. The tubular sleeve 45 at the lower portion of the control module 23 engages an upper end of a vertical post 54. The lower end of the post 54 engages a base plate 55 which rests on the road 53. Movement of the vertical post 54 is resisted by a pair of vehicle wheels 56 which rest on the base plate 55. The post 54 is preferably made of telescopic sections for compact storage when it is not in service.

Figure 8:
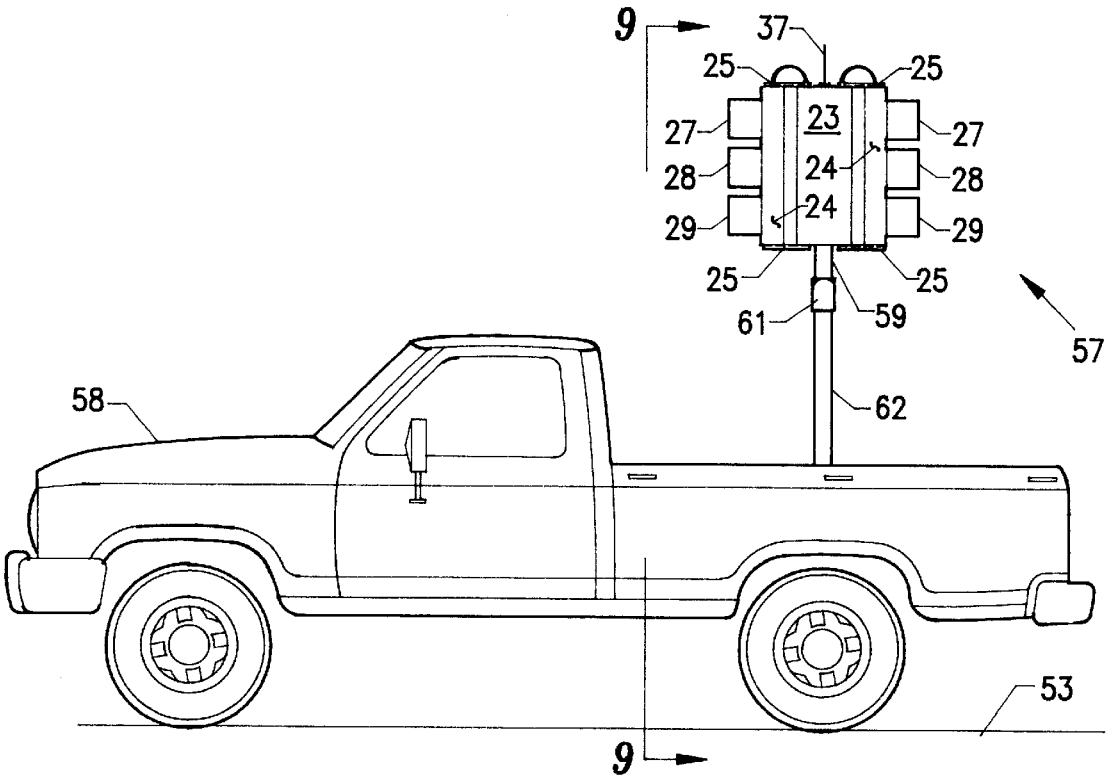
FIG. 8 is a side elevational view of a third embodiment.
Figure 9:
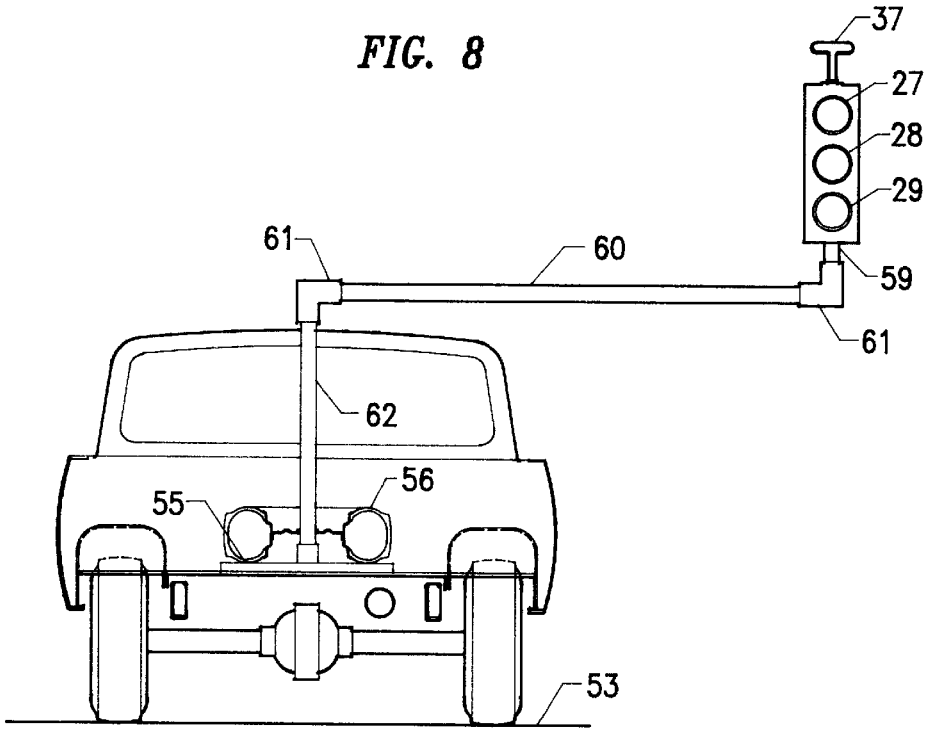
FIG. 9 is a cross-sectional view taken on the line 9—9 in FIG. 8.
Figure 10:
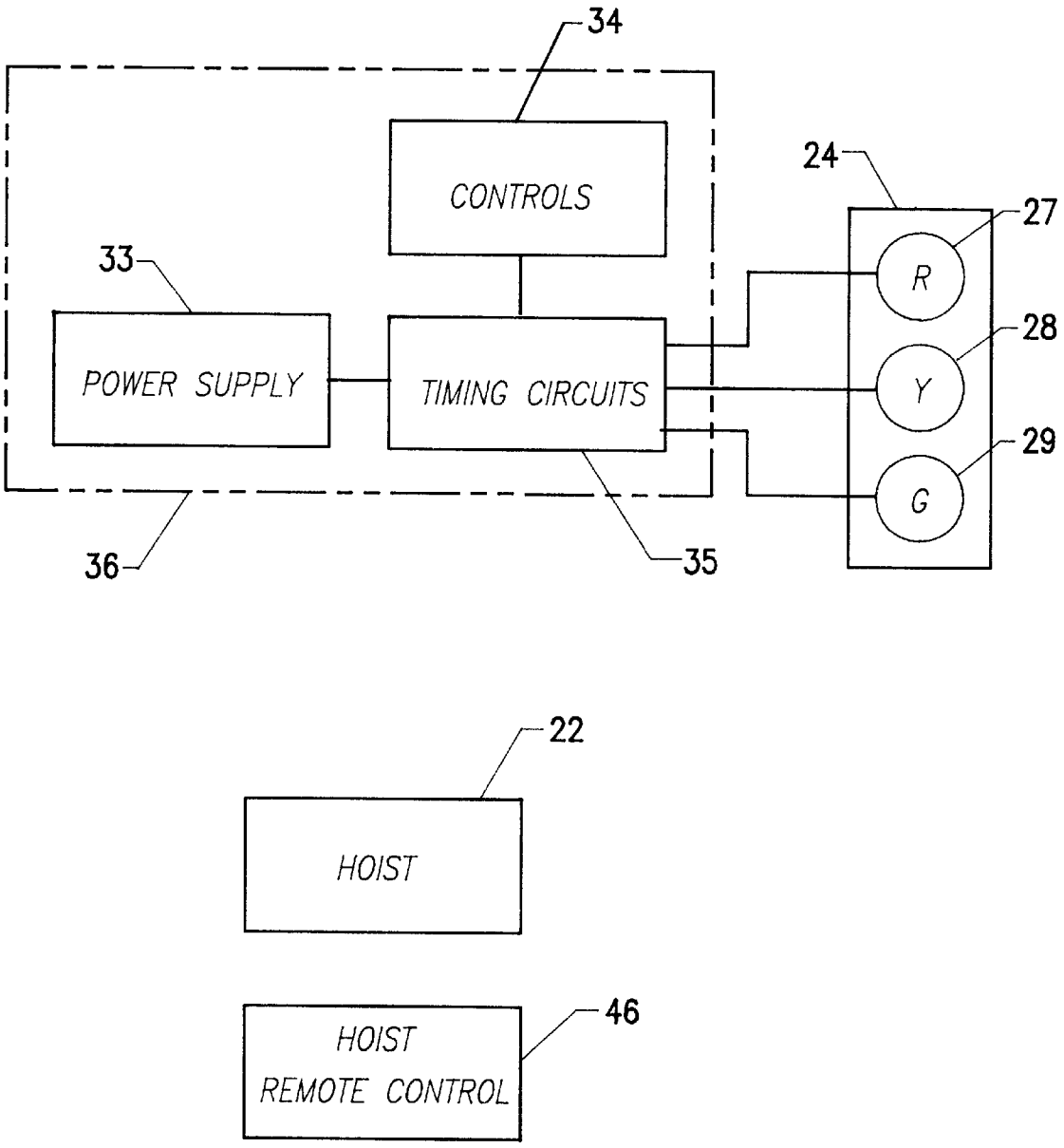
FIG. 10 is a schematic diagram of a portable traffic signal according to the invention.

In FIGS. 8 and 9 an embodiment 51 is shown in which the traffic signal 20 is stationed on a bed of a pick-up truck 58. The tubular sleeve 45 at the bottom of the control module 23 receives an upper end portion of a short vertical post 59. The lower end portion of the vertical post 59 is attached to an outer end portion of a horizontal tubular arm 60 with a 90 degree coupling 61. The inner end portion of the horizontal arm 60 is attached to the upper end portion of a second vertical post 62. The lower end portion of the second post 62 engages a base plate 55 which rests on the bed of the pick-up truck 58. Movement of the vertical post 62 is resisted by a vehicle wheel 56 which rests on the base plate 55. One advantage of this embodiment 57 is that the power supply of the pick-up truck 58 may be used in place of the control module battery 33 for supplying current to the lights 27, 28 and 29 and timing circuits 35.

From the foregoing it will be appreciated that my traffic signal provides numerous advantages and benefits over the prior art. It can be easily assembled, disassembled and transported in compact form in a vehicle luggage compartment or a commercial vehicle. Moreover, it eliminates the use of police and signalmen for controlling traffic, can be quickly placed in service and reduces costs of road repairs.

Although only several embodiments of my invention have been disclosed, it will be understood that other embodiments can be derived by obvious substitution of parts as well as changes in shape, materials and arrangements of parts without departing from the spirit thereof.

I claim:

1. A portable traffic signal for traffic control at intersections, school crossings, traffic accidents, road repairs, and road construction comprising: a control module, said control module having a housing, a power supply mounted in said housing, a means on a top portion of said module for attaching said module to an overhead cable, and a power operated means attached to said module for raising and lowering said traffic signal from a ground level non-operative position to an elevated operative position on said overhead cable; and at least one detachable light panel attached to said control module, said light panel having a housing and a vertical array of lights mounted in said housing.

2. The traffic signal as recited in claim 1 wherein said means mounted on said control module for raising and lowering said traffic signal is a power operated hoist, said power operated hoist having a hook for attaching said traffic signal to said overhead cable, said hook having a tapered rubber liner for preventing said hook from moving on said overhead cable; and a rotatable means for orienting said module on said overhead cable.

3. The traffic signal as recited in claim 1 further comprising a transmitting signal means in said control module for synchronizing an "on" and "off" operation of said array of lights of said traffic signal with lights of other traffic signals.

4. The traffic signal as recited in claim 1 further comprising a means on said control module for optionally supporting said traffic signal on a road surface.

5. The traffic signal as recited in claim 4 wherein said means on said control module for optionally supporting said traffic signal on a road surface comprises a tubular sleeve attached to a lower portion of said control module; a slender cylindrical vertical post having an upper end portion engaging said tubular sleeve; and a base plate engaging a lower end portion of said vertical post.

6. The traffic signal as recited in claim 1 further comprising a means attached to said control module for optionally supporting and extending said traffic signal outwardly from a cargo bed of a truck.

7. The traffic signal as recited in claim 6 wherein said means on said control module for optionally supporting said traffic signal on a cargo bed of a truck comprises a tubular sleeve attached to a lower portion of said control module; a short, slender, cylindrical vertical post having an upper end portion engaging said tubular sleeve; and a base plate engaging a lower end portion of said vertical post, said post and base plate being adapted to rest at least one vehicle wheel on an upper surface of said base for retaining said traffic signal on said bed of said truck.

8. The traffic signal as recited in claim 1 further comprising a transmitter mounted in said module for synchronizing an "on and off" operation of each light in said array of lights with the operation of lights of other traffic signals.

9. A portable traffic signal for traffic control at intersections, school crossings, traffic accidents, road repairs, and road construction comprising: a control module, said control module having a housing, a power supply mounted in said housing, at least one light panel removably attached to said control module, said light panel having a housing and a vertical array of lights mounted in said housing; a means mounted on a top portion of said control module for attaching and suspending said traffic signal from an overhead cable; a power operated means for raising and lowering said module from a around level non-operative position to an elevated operative position on said overhead cable; a means attached to a lower portion of said control module for optionally supporting said traffic signal on a road surface; and a means for transmitting signals to synchronize the operation of said array of lights with the operation of lights of other traffic signals.

10. A method for traffic control at intersections, school crossings, traffic accidents, road repairs, and road construction comprising: assembling at least one detachable light panel having a vertical array of lights to a control module, said module having a means for synchronizing an "on" and "off" operation of each of said lights with an "on" and "off" operation of lights of other traffic signals, synchronizing said "on" and "off" operation of said lights with the "on" and "off" operation of said lights of said other traffic signals, raising said traffic signal with a power operated hoist attached to said module from a around level non-operative position to an elevated operative position on an overhead cable and attaching said traffic signal to said overhead cable.

11. A portable traffic signal for traffic control at intersections, school crossings, traffic accidents, road repairs, and road construction comprising: a control module, said control module having a housing, a power supply mounted in said housing, a means on a top portion of said module for attaching said module to an overhead cable, a power operated hoist, attached to said module for raising and lowering said traffic signal from said overhead cable, said power operated hoist having a hook for attaching said traffic signal to said overhead cable, said hook having a tapered rubber liner for preventing said hook from moving on said overhead cable; a rotatable means for orienting said module on said overhead cable; and at least one detachable light panel attached to said control module, said light panel having a housing and a vertical array of lights mounted in said housing.

12. The traffic signal as recited in claim 11 further comprising a slender rod for engaging, raising, and lowering said hook to disconnect said module from said overhead cable.

* * * * *

UNITED STATES PATENT AND TRADEMARK OFFICE

CERTIFICATE OF CORRECTION

PATENT NO. : 5,805,081

DATED : September 8, 1998

INVENTOR(S) : Karel John Fikacek

It is certified that error appears in the above-indentified patent and that said Letters Patent is hereby corrected as shown below:

Column 5, line 36, change "around" to --ground--

Column 6, line 14, change "around" to --ground--

Signed and Sealed this

First Day of December, 1998

*Attest:*

*Attesting Officer*

BRUCE LEHMAN

*Commissioner of Patents and Trademarks*